United States Patent [19]

Smith

[11] 3,980,301

[45] Sept. 14, 1976

[54] WOOD GOLF CLUB IMPROVEMENT

[76] Inventor: Kenneth L. Smith, 12925 W. 71st St., Lenexa, Kans. 66015

[22] Filed: June 26, 1975

[21] Appl. No.: 590,691

[52] U.S. Cl. ..... 273/80.2; 273/80 C; 273/167 G

[51] Int. Cl.[2] ..... A63B 53/02

[58] Field of Search ..... 273/77 R, 80 C, 80.1, 273/80.2–80.8, 164, 167–175; D34/5 GC, 5 GH

[56] References Cited

UNITED STATES PATENTS

| | | | |
|---|---|---|---|
| 1,250,296 | 12/1917 | Fitzjohn | 273/167 G X |
| 2,088,095 | 7/1937 | Sargent et al. | 273/80 C |
| 2,478,468 | 8/1949 | Drake | 273/175 X |
| 2,880,002 | 3/1959 | Wetty | 273/167 K X |
| 3,166,320 | 1/1965 | Onions | 273/80 C |
| 3,519,271 | 7/1970 | Smith | 273/167 K X |
| D197,471 | 2/1964 | Handelan | 273/80 C X |

FOREIGN PATENTS OR APPLICATIONS

| | | | |
|---|---|---|---|
| 20,914 | 11/1894 | United Kingdom | 273/167 G |
| 20,792 | 9/1909 | United Kingdom | 273/167 K |
| 899,562 | 6/1962 | United Kingdom | 273/80 C |

OTHER PUBLICATIONS

"Golf World"; May 2, 1972; p. 11.

*Primary Examiner*—Richard J. Apley
*Attorney, Agent, or Firm*—Thomas M. Scofield

[57] ABSTRACT

In a wood golf club wherein the club head is connected to the shaft by a generally L-shaped connecting member. The connecting member has (a) one leg received within and internally connected in the lower half of the club head and in general parallelism with the striking face and (b) the other leg has lower and upper portions wherein the lower portion extends upwardly from the one leg at substantially a right angle in a forward and upward direction and the upper portion is of an obtuse, angular configuration and connected to the lower extremity of the golf shaft and is so configured that the longitudinal axis of the shaft and upper portion extends downwardly, passing behind the striking face but positioned closer thereto than the longitudinal axis of the one leg.

10 Claims, 5 Drawing Figures

WOOD GOLF CLUB IMPROVEMENT

BACKGROUND OF THE INVENTION

The manufacture of strong, longlived wood golf club heads presents special problems. Typically, the conventional, wood club clubhead is a shaped body having a more or less angled, flattened striking face, a toe and a heel, a flattened sole and a rounded topside. An angled, but generally upwardly extending neck is formed integrally with the clubhead and projects generally upwardly from the heel side or end of the wood golf club head.

There is an inherent conflict in the use of an integral, single piece of wood to form the clubhead of a wood golf club. Thus, with respect to the striking of the ball, the optimum arrangement of the grain would be for it to be aligned with the strike (like the grain in a mallet head) for strength. However, it is necessary to provide the clubhead with the grain running down the neckline or excessive breakage is encountered. Even when the latter grain pattern is provided, as the neck of the clubhead is tapered upwardly, end grain is left, which permits splitting in the neck zone of the golf club.

Basically, wood golf clubs, per se, are quite simple (in principle) in construction. That is, there is the wood head of the club which conventionally includes the angled, but generally upwardly extending neck, the shaft of the club, the grip on the upper end of the shaft and means for securing the shaft to the clubhead. In the conventional connection, the downwardly tapering neck portion of the wood golf club is drilled out to receive the elongate, conventionally downwardly tapered, lower end of the hollow metal shaft. Once the shaft has been inserted into the drilled out portion of the neck and clubhead, the heel of the clubhead is drilled from the rear forwardly through the metal shaft and a threaded pin inset, thus to lock the hollow steel shaft against rotation in the clubhead or pulling out therefrom.

With respect to the visible portion of the securement of the conventional shaft to the conventional clubhead, it is ancient and customary in the industry to either wrap string around the upper portion of the clubhead neck and the lower portion of the golf club shaft and leave such exposed, or, alternatively, cover this winding with a plastic collar. Such string and such collar are conventionally black. Sometimes the plastic collar is put on and the string is not used.

The first five woods are well-known to almost every golfer. These comprise the No. 1 (driver), No. 2 (brassie), No. 3 (spoon), No. 4 (cleek) and No. 5 (baffy). However, many golfers have sets of ten woods, numbered 1 through 10. The No. 5 wood plays about the same distance as a No. 3 iron, the No. 6 wood like a No. 4 iron, etc. down to the No. 10 wood like the No. 8 iron. The No. 10 wood, playing about like the 8 iron, is the practical minimum distance for a wood club. Typically, the loft differential between individual ones of such a set of ten is only 3° per club.

The following table of Average Specifications For Men's Woods gives, for the said ten woods (1 through 10) the width and depth of various head sizes, as well as the lie, loft and average length of all men's models.

The breakage problem with wood golf club heads is particularly present with the more lofted woods.

There are particular fitting problems with wood golf clubs which must be taken into account with respect to an individual golfer's playing characteristics which relate to the relationship of the neck of the wood gold club head and the head proper. Thus, the proper lie of the club differs from golfer to golfer. For example, when two golfers take a comfortable stance with their drivers, the perpendicular distance from the center of the tip of the shaft to the floor will typically differ. This means that the angle of the neck with respect to the head of the club, when viewed from the striking face of the head, will differ from golfer to golfer, or may so differ.

Next, there is the question of whether the golfer tends to hook long shots or tends to slice them. This means, for a given golfer, that the hitting face may best preferably be angled somewhat one way or the other, depending upon the golfers natural hitting tendency with a wood club. Said simply, for a natural slicer, the angle of the hitting face best differs than for a natural hooker. This means that the angle of the neck going into the head of the club, when the clubhead is used from above will be positioned at a different angle relative the striking face for a normally hooking golfer than for a normally slicing golfer.

Thus, it may be seen that it would be desirable to eliminate the neck of wood golf clubs, provided that a connecting means between the clubhead, per se and the lower end of the shaft may be developed which will permit the solution of the various problems above enumerated. My U.S. Pat. No. 3,519,271, issued July 7, 1970 for "Shaft and Clubhead Attaching Means" is a first step toward satisfactorily solving the problems of eliminating the neck of a wood golf club, while yet providing means for dealing with such problems. The instant development is particularly directed to providing an improved connection having use over the entire range of wood golf clubs independent of the markedly varying angles of the club striking faces.

Still another point with respect to conventional wood golf clubs is that the neck of these clubs is an important source of wind drag as the club is swung. In the instant improvement, by eliminating the conventional wood club neck construction, the said wind drag caused by this portion of the club has been substantially eliminated.

TABLE I

AVERAGE SPECIFICATIONS FOR MEN'S WOODS

| | MEDIUM DEEP HEAD | | MEDIUM SMALL HEAD | | NARROW HEAD | | AVERAGE ALL MEN'S MODELS | | |
|---|---|---|---|---|---|---|---|---|---|
| | Width | Depth | Width | Depth | Width | Depth | Lie | Loft | Average Length |
| Driver No. 1 | 2-30/32" | 1-9/16" | 2-14/16" | 1-1/2" | 2-20/32" | 1-14/32" | 54 | 10–12 | 43 |
| Brassie No. 2 | 2-29/32" | 1-13/32" | 2-13/16" | 1-11/32" | 2-20/32" | 1-12/32" | 55 | 13–15 | 42-1/2 |
| Spoon No. 3 | 2-28/32" | 1-5/16" | 2-12/16" | 1-9/32" | 2-20/32" | 1-10/32" | 56 | 16–18 | 42 |
| Cleek No. 4 | 2-23/32" | 1-9/32" | 2-11/16" | 1-1/4" | 2-20/32" | 1-9/32" | 57 | 19–21 | 41-1/2 |
| Baffy No. 5 | 2-20/32" | 1-1/4" | 2-10/16" | 1-7/32" | 2-20/32" | 1-9/32" | 58 | 22–24 | 41 |
| No. 6 Wood | 2-20/32" | 1-9/32" | 2-9/16" | 1-9/32" | 2-20/32" | 1-9/32" | 59 | 25–27 | 40-1/4 |

TABLE I-continued

AVERAGE SPECIFICATIONS FOR MEN'S WOODS

| | MEDIUM DEEP HEAD | | MEDIUM SMALL HEAD | | NARROW HEAD | | AVERAGE ALL MEN'S MODELS | | |
|---|---|---|---|---|---|---|---|---|---|
| | Width | Depth | Width | Depth | Width | Depth | Lie | Loft | Average Length |
| No. 7 Wood | 2-20/32" | 1-10/32" | 2-9/16" | 1-10/32" | 2-20/32" | 1-10/32" | 60 | 28–30 | 39-1/2 |
| No. 8 Wood | 2-20/32" | 1-11/32" | 2-9/16" | 1-11/32" | 2-20/32" | 1-11/32" | 61 | 31–33 | 38-3/4 |
| No. 9 Wood | 2-20/32" | 1-12/32" | 2-9/16" | 1-12/32" | 2-20/32" | 1-12/32" | 62 | 34–36 | 38 |
| No. 10 Wood | 2-20/32" | 1-13/32" | 2-9/16" | 1-13/32" | 2-20/32" | 1-13/32" | 63 | 37–39 | 37-1/4 |

OBJECTS OF THE INVENTION

The basic object of the instant invention is to provide improved wood golf clubs.

Another object of the invention is to provide improved means for attaching the clubhead of a wood golf club to the shaft of the club.

Another object of the invention is to provide an improved wood golf club construction in which the clubhead and the normally lowermost end of the club shaft are interconnected to one another without employment of the typical tapered neck or hosel conventionally forming a part of the wood golf club head.

Another object of the invention is to provide improved wood golf clubhead-shaft interconnection means which are an improvement over the shaft and clubhead attaching means seen in the patent to Kenneth L. Smith, U.S. Pat. No. 3,519,271, issued July 7, 1970.

Another object of the invention is to provide such a novel connection between shaft and clubhead for a wood golf club that, in the clubhead, the grain may be aligned with the strike, for strength (like a mallet), or grain substantially parallel to the face, rather than having the grain in the clubhead aligned with the axis of the neck to avoid breakage, as is necessary in conventional wood golf club heads. This is an option usable or not as desired. Laminated wood may be used in the same manner.

Another object of the invention is to provide such a novel clubhead-club shaft connecting means for a wood golf club that, by varying the angle of the connecting means that goes into the wood golf club head, the manufacturer can vary the face angle and also the lie of the club.

Another object of the invention is to provide improved means for connecting the head and shaft of a wood golf club to one another wherein woods with any desired degree of loft may be provided, yet the shaft may be positioned, as desired, in line with the striking face of the wood golf club and, additionally, problems of splitting and breakage in the neck of the club are completely obviated and removed.

Another object of the invention is to provide such an improved wood golf club shaft-clubhead connecting means wherein the shaft may either be downwardly tapered or of uniform internal diameter in the length thereof. The shaft may be received in the connecting member (22*c*) or the connecting member (22*c*) may go into the lower end of the shaft (19).

Another object of the invention is to provide improved wood golf club head-shaft connecting means which remove the necessity of use of a neck integral with the clubhead and, as well, the employment of the conventional wood golf head shaft-clubhead connection, yet wherein the full face of the clubhead is preserved as a striking face no matter what the loft of the wood may be.

Other and further objects of the invention will appear in the course of the following description thereof.

In the drawings, which form a part of the instant specification and are to be read in conjunction therewith, an embodiment of the invention is shown and, in the various views, like numerals are employed to indicate like parts.

Figure 1:
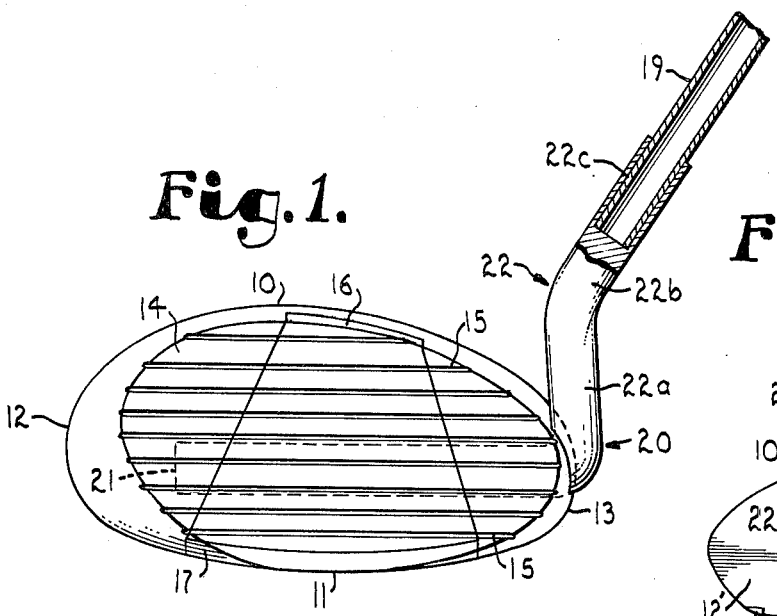
FIG. 1 is a front elevational view of the lower portion of a wood golf club embodying the subject improvement, the striking face of the club facing the observer, the upper righthand corner of the view sectioned to better show the connection of the shaft to the member connecting the lower end of the shaft to the clubhead.

Turning to the drawings, the clubhead per se will be first described. This description will be taken with the clubhead oriented as if grounded, in normal play, immediately preparatory to use in making a shot. In such case, the sole of the club is substantially flat on the ground with the shaft extending upwardly and laterally toward the golfer's hands which are in the lowermost position which they take in play of the club.

The clubhead has a topside 10, a sole 11, a toe 12 and a heel 13. The forward, leading or striking face 14 is usually slightly bulged both vertically and horizontally, or substantially so and also typically has horizontal grooves 15 formed or cut therein. A striking insert 16, defining the optimum impact area, may be provided. Sole plates 17 of suitable conventional configuration may be employed. Backweights (unseen) may be used. The grain of the wood employed may or may not be oriented so the striking face of the head is the end grain of the block. That is, in the view of FIG. 1, observer would be looking at the end grain if this orientation were employed or laminated wood may be used.

Only the lowermost extremity of shaft 19 is shown. The shaft may be of any suitable type depending upon the needs of the player and is provided with a conventional handle at its upper end. FIGS. 1–4, inclusive show a downwardly tapered shaft.

The connecting member between the wood golf club clubhead and the lower end of the shaft will be now described. This connecting member is generally designated 20, being made up of a normally horizontal leg 21 and a normally upright leg generally designated 22. The latter has a lower length 22*a* and an upper length 22*b* forming an approximate right angle with one another. In certain cases this may be an obtuse angle substantially greater than 90°. This exact angle is dependent upon the height, reach and stance of the player in the case of custom-made clubs.

In the view of FIG. 1, namely, looking toward the striking face 14, lower leg 21 is connected to length 22 at substantial (but not necessarily at) right angles, whereby length 22, if desired, extends slightly over the topside 10 of the clubhead. Lower leg 21 preferably extends substantially horizontally in the view of FIG. 1 and substantially (but not necessarily) parallel to striking face 14 in the view of FIG. 4. The length of leg 21 is preferably that shown in connected dotted lines in FIGS. 1 and 4, but may be extended a greater distance as seen at 21*a* in FIG. 4. If desired, leg 21 may be extended completely to the toe of the clubhead.

Legs 21 and 22 are shown integral with one another and formed from solid bar stock. The upper length 22*b* is shown bored as at 22*c'* to receive therewithin the lowermost extremity of shaft 19. The common longitudinal axis of length 22*b* and shaft 19 extends therefrom downwardly through the club head, from the heel 13 toward the toe 12 for optimum balance. Shaft 19 and bored section 22*c* may be glued, pinned or otherwise attached to one another in conventional fashion. Optionally, either or both of members 21 and 22 may be formed from hollow tube stock.

Figure 2:
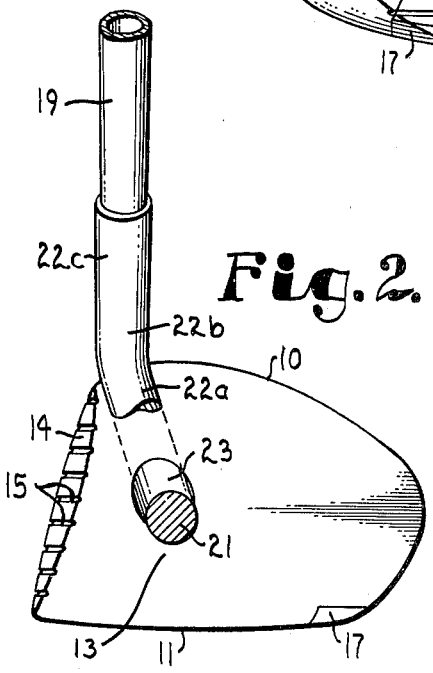
FIG. 2 is a view from the heel end of the club, taken from the righthand side of FIG. 1 looking to the left in the view of FIG. 1, the lower end of the member communicating between the wood golf club clubhead and the shaft cutaway to better show the interengagement thereof with the head of the club.
Figure 4:
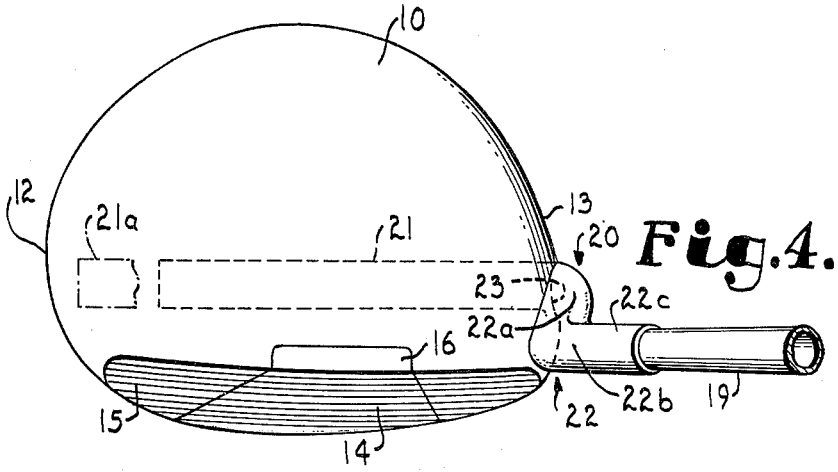
FIG. 4 is a plan view, from above, of the wood golf club of FIGS. 1–3, inclusive.

As may be clearly seen from FIGS. 2 and 4, the longitudinal axis of upper length 22*b* and shaft 19 passes behind the striking face. A vertical plane through this line passes entirely behind the striking face 14 in order to achieve proper balance in the club. This clearance or essential clearance or face 14 by length 22*b* and shaft 19 is also necessary in order that the entire striking face 14 be clear for impact against the ball.

At least the longitudinal axis of the lower leg 21, and preferably the entirety thereof, is positioned below a plane horizontally dividing the clubhead in two. This lower leg 21 is, additionally, spaced rearwardly (to the right in FIG. 2 and upwardly in FIG. 4) away from the striking face 14 for dual purposes, namely, proper balance with the clubhead and strength of the clubhead. Lower leg 21 is preferably glued into the clubhead, which is bored to receive it in close fit.

Figure 3:
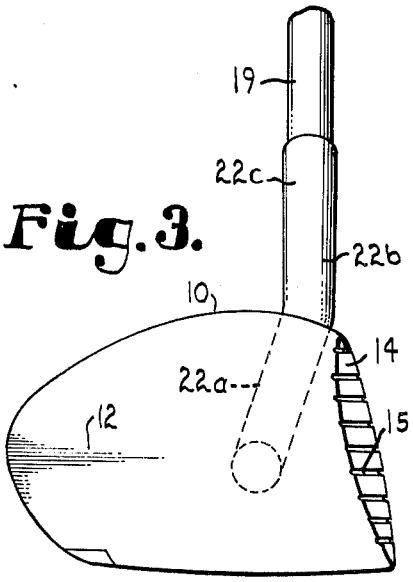
FIG. 3 is a view looking at the toe of the golf club, taken from the lefthand side of FIG. 1 and looking from left to the right in the view of FIG. 1.

The lower length 22*a* of upper leg 22 is angled from the vertical, as may be clearly seen in FIGS. 2–4, inclusive. Additionally, the wood of the clubhead heel 13 is preferably arcuately relieved, at least somewhat, as seen at 23 in order that lower length 22*a* may overlie, preferably, some part of upper face 10 of the clubhead. The degree of rearward angling of lower length 22*a* from the vertical plane through the longitudinal axis of shaft 19 and upper length 22*b* is dependent upon the desired rearward spacing of lower leg 21 with respect to the striking face, the desired closeness of the longitudinal axis of shaft 19 and upper length 22*b'* with respect to the striking face and the loft of the club.

As was noted, the desired lie of the club differs for a given golfer. The vertical distance from tip of shaft to ground marks a key measurement determining the correct sole angle or "lie". Drivers are made (custom) with lies as flat as 45° and as upright as 62°. Additionally, for a given golfer, the angle of the face of the wood club with the shaft may vary. The optimum is determined with respect to the individual golfer's tendency to hook long shots, average them about straight or slice them considerably. Many golfers need wood clubs with faces somewhat open. Other achieve best results with a slightly hooked face. The face of the club in FIG. 4 is slightly open, for example. With these variabilities, the preferences remain that (1) the angle of leg 21 to leg 22 is best about 90° or slightly more or less and (2) the lower length 22*a* is best rearwardly and downwardly angled (in view from heel or toe) with respect to the longitudinal axis of shaft 19 and upper length 22*b* and the vertical plane therethrough. Said otherwise, the said longitudinal axis and vertical plane therethrough are forward of the longitudinal axis of lower leg 21 in the preferred embodiment of the instant invention. The angle of leg 21 to leg 22 may vary in the range of 75° to 105° with one another viewing toward said hitting face.

Figure 5:
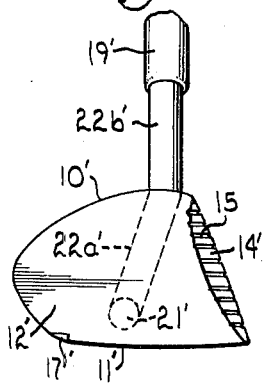
FIG. 5 is a view like that of FIG. 3 showing a club differing from that seen in FIGS. 1–4, inclusive in that the club has greater loft, the clubhead connection is lowered therein toward the sole and the shaft connection is reversed from that of FIG. 1.

FIG. 5 shows a view looking at the toe of a modified golf club from that of FIGS. 1–4, inclusive. The differences are three in number:

1. The loft of the club in FIG. 5 is greater than the loft of the club in FIGS. 1–4, inclusive;

2. The lower leg received horizontally within the clubhead is positioned lower in the clubhead in FIG. 5 and further to the rear of the striking face;

3. A non-tapering shaft is employed, whereby the upper portion of the connecting member is solid and enclosed by the uniform internal diameter hollow shaft.

These parts of the golf club which are the same or substantially the same in FIG. 5 as the club of FIGS. 1–4, inclusive are numbered the same, but primed.

Generally speaking, the lower leg or member 21 in the head, the more loft is possible in the club. Varying the angle of the connection between leg 21 and lower length 22*a* will vary the lie of the club. This also may be varied by changing the bend between the upper and lower lengths 22*a* and 22*b*. By varying the backward bend of the lower length 22*a* with respect to the vertical plane through the axes of shaft 19 and leg 22*b*, as well as the length of lower length 22*a*, permits a very precise control as to the balance of the club and clubhead. The latter factors of variance, together with the option of translating the vertical plane through the axes of shaft 19 and length 22 rearwardly or forwardly with respect to the striking face give great adaptability for all degrees of club loft. The length of lower length 22 both with respect to the position of leg 21 in the clubhead (lower or higher with respect to the sole) and the position of the bend between the length 22*a* and 22*b* may be varied. All of these factors give an extraordinarily versatile control of club design not heretofore present in wood golf clubs with respect to control of balance, center of gravity, lie and face angle.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. In a wood golf club, described with the club head grounded in normal play, a club head provided with a toe and a heel at opposite ends thereof, a sole and a slightly arcuate, somewhat inclined striking face on the leading side of said head, an elongate shaft having a lowermost extremity, a generally L-shaped, in view toward the striking face of the club head, integral connecting member made up of two legs, a first one of said connecting member legs being received within and internally connected to said head and extending longitudinally therewithin from the heel towards the toe thereof in a direction substantially parallel to said striking face, said first leg entering the club head through the heel thereof, extending in substantially horizontal direction therewithin and spaced rearwardly within said club head with respect to said striking face, the other leg having lower and upper lengths thereof forming a substantially obtuse angle with one another viewing toward said striking face, the lower length of said other leg extending, in view toward said striking face, at substantial right angles to said first leg in substantially vertical orientation, the upper length being connected to the lowermost extremity of the shaft and extending downwardly therefrom in longitudinal alignment therewith, the longitudinal axis of the shaft and said upper length, extended downwardly, passing behind the striking face of the club head, but positioned more closely thereto than the longitudinal axis of said first leg, whereby the lower length, in view towards the heel of the club head, is angled forwardly and upwardly from its connection with the first leg toward the striking face of the club head and its connection with the upper length of said other leg.

2. A wood golf club as in claim 1, wherein the connection of the first leg to the club head is sufficiently spaced rearwardly within the club head that the most leading portion of the lower length is positioned at least somewhat rearwardly of the striking face of the club head.

3. A wood golf club as in claim 1 wherein the lowermost portion of the lower length of the other leg is partially received within the heel of the club head.

4. A wood golf club as in claim 1 wherein the angle of connection of the first leg and lower length, viewed toward the clubface, is about 90°, whereby the upper portion of the lower length slightly overlies the heel of the clubhead.

5. A wood golf club as in claim 1 wherein the lowermost portion of the lower length is partially received with the heel of the club head and the angle of connection of the first leg and lower length, viewed toward the club face, is about 90°, whereby the upper portion of the lower length overlies the heel of the club head.

6. A wood golf club as in claim 1 wherein said club head has a top side and a sole, the latter contacting the ground in substantial horizontal relationship, said first leg positioned substantially closer to said sole than to said top side, whereby to be at least substantially entirely received within the lower portion of said club head.

7. A wood golf club as in claim 1 wherein the transition between the upper and lower lengths is closely positioned above the top of the clubhead.

8. A wood golf club as in claim 1 wherein the transition between the upper and lower lengths is closely positioned above the top of the clubhead and the angle of connection of the first leg and lower length, viewed toward the club striking face, is about 90°, whereby the upper portion of the lower length slightly and closely overlies the heel of the clubhead.

9. A wood golf club as in claim 1 wherein said club head has a top side and a sole, the latter contacting the ground in substantially horizontal relationship, said first leg positioned substantially closer to said sole than to said top side, whereby to be at least substantially entirely received within the lower portion of said club head, the lowermost portion of the lower length is partially received within the heel of the club head, and the angle of connection of the first leg and lower length, viewed toward the club face, is about 90°, whereby the upper portion of the lower length overlies the heel of the club head.

10. A wood golf club as in claim 1 wherein the lowermost portion of the lower length is partially received within the heel of the club head, the angle of connection of the first leg and lower length, viewed toward the club face, is about 90°, whereby the upper portion of the lower length overlies the heel of the club head, and the transition between the upper and lower lengths is closely positioned above the top of the club head.

* * * * *